United States Patent [19]

Nagamoto

[11] Patent Number: 4,479,652

[45] Date of Patent: Oct. 30, 1984

[54] WOOD-TYPE GOLF CLUB HEAD

[75] Inventor: Itsushi Nagamoto, Shizuoka, Japan

[73] Assignee: Nippon Gakki Seizo Kabushiki Kaisha, Japan

[21] Appl. No.: 499,997

[22] Filed: Jun. 1, 1983

[30] Foreign Application Priority Data

Jun. 26, 1982 [JP] Japan ..... 57-110473

[51] Int. Cl.[3] ..... A63B 53/04

[52] U.S. Cl. ..... 273/172; 273/167 H

[58] Field of Search ..... 273/173, 174, 167 H, 273/169, 171, 172

[56] References Cited

U.S. PATENT DOCUMENTS

| | | | |
|---|---|---|---|
| 1,213,382 | 1/1917 | Kent | 273/171 |
| 2,171,383 | 8/1939 | Wettlaufer | 273/171 |
| 2,457,084 | 12/1948 | Kearsley et al. | 273/174 X |
| 2,809,838 | 10/1957 | Oquist | 273/169 X |
| 3,547,445 | 12/1970 | Hardesty | 273/173 |

*Primary Examiner*—George J. Marlo

*Attorney, Agent, or Firm*—Lerner, David, Littenberg, Krumholz & Mentlik

[57] ABSTRACT

A wood-type golf club head includes an additional weight strap embedded, on the sole side, in the section of the fiber reinforced plastic shell preferably in a secured relationship to the sole plate for lower positioning of the center of gravity and firm holding of the sole plate against shock at hitting balls.

4 Claims, 2 Drawing Figures

WOOD-TYPE GOLF CLUB HEAD

BACKGROUND OF THE INVENTION

The present invention relates to a wood-type golf club head, and more particularly relates to improvement in construction of a wood-type golf club head including a shell made of fiber reinforced plastic.

A conventional wood-type golf head in general includes a main body made of wood such as persimon or maple, and the main body is provided with a face plate made of ABS resin or the like attached to its face side and a sole plate made of brass or the like attached to its sole side in order to increase impact by inertia at hitting balls.

However, recent general trend of difficulty in obtaining high quality wooden materials has disenabled easy low cost production of such wood-type golf club head. In addition, the relatively complicated configuration of the wood-type golf club head has required high technique in production which naturally furthered the difficulty in their low cost production. For these reasons, it is now next to impossible to supply wood-type golf club heads of admissible quality at low prices despite the significant increase in demand on market.

In order to meet this situation, an artificial wood-type golf club head has already been proposed as a substitute for the natural wood head. Such an artificial golf club head includes a fiber reinforced plastic shell injected with foam synthetic resin as a core. However, the above-described complicated configuration of the wood-type golf club head has made it quite difficult to employ this proposal in the real commercial production at reasonable costs. Further, the swing of a golf club is subtly influenced by the position of the center of gravity in the construction of its club head. In other words, the position of the center of gravity should be carefully and subtly adjusted in accordance with the type of club head. Among various attachments on a club head, a sole plate attached to the sole side of the club head is thought to be most influential on the position of the center of gravity. However, there is a certain limit to free adjustment in position of the center of gravity by adjustment in weight of the sole plate since the sole plate must have a size large enought to guard most of the sole side of the club head and must be exposed on the surface of the club head. The construction of the above-described early proposal cannot go beyond this limit to adjustment in position of the center of gravity. In addition, this construction cannot avoid the danger of accidental separation of the sole plate since the sole plate is attached to the fiber reinforced plastic body only by set screws.

SUMMARY OF THE INVENTION

It is the object of the present invention to provide a wood-type golf club head including a means for adjusting the position of the center of gravity during production of the club head.

It is another object of the present invention to provide a wood-type golf club head with a stablized attachment of the sole plate.

In accordance with the basic aspect of the present invention, a metallic weight strap is fully embedded in and embraced by the section of the fiber reinforced plastic shell defining the sole side of a wood-type golf club head.

DESCRIPTION OF THE PREFERRED EMBODIMENT

Figure 1:
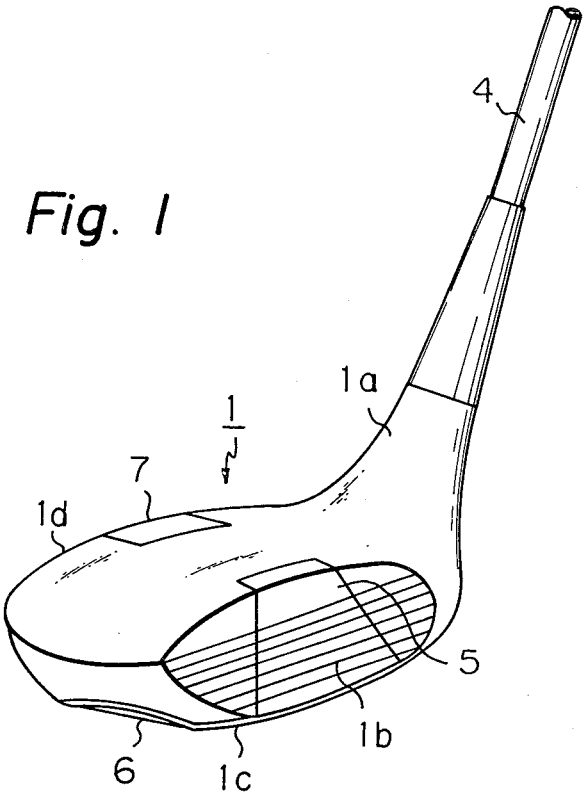
FIG. 1 is a perspective view of one example of the wood-type golf club head to which the present invention is advantageously applied.

One example of the wood-type golf club head is shown in FIG. 1, in which a club shaft 4 is secured to the neck section 1*a* of the club head 1. The club head 1 is further provided with a face plate 5 made of ABS resin or the like and attached to the face side 1*b*, a sole plate 6 made of a brass strap and attached to the sole side 1*c* and a metallic weight attached to the back side 1*d*.

Figure 2:
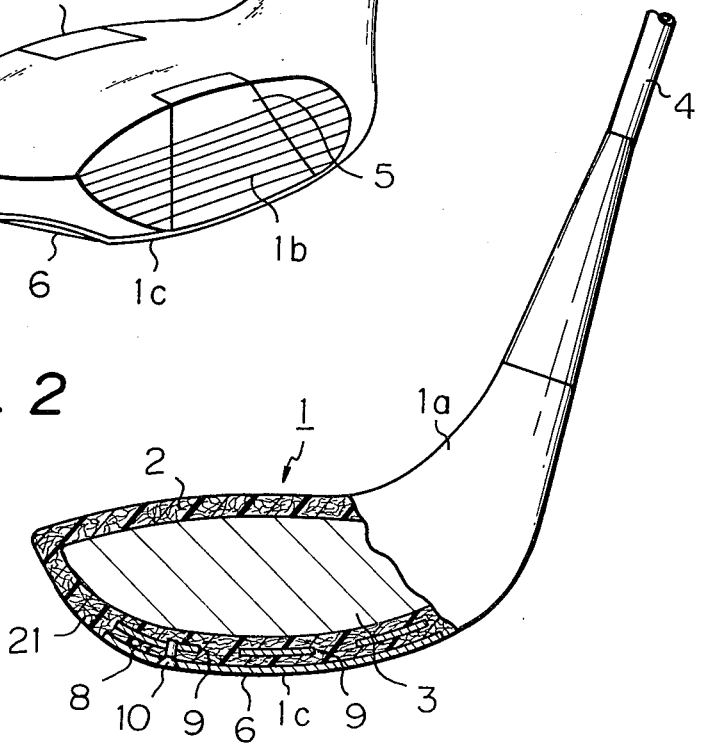
FIG. 2 is a side view, partly in section, of a wood-type golf club head in accordance with the present invention.

One embodiment of the golf club head in accordance with the present invention is shown in FIG. 2. The golf club head 1 of this embodiment has a solid construction including a core 3 made of wood or foamed synthetic resin and a fiber reinforced plastic shell 2 embracing the core 3. The present invention is, however, well applicable to a golf club head having a hollow construction made up of a fiber reinforced plastic shell 2 only.

In either case, a metallic weight strap 8 is firmly embedded in and embraced by the section of the fiber reinforced plastic shell 2 defining the sole side 1*c* of the golf club head 1 in an arrangement substantially parallel to and generally coextensive with the sole plate 6 on the sole side 1*c*. The weight strap 8 preferably has a number of perforations 9, which are filled with the fiber reinforced plastics forming the shell 2. In a further preferred embodiment, the sole plate is coupled to the weight strap 8 by means of screws 10.

Since the weight strap 8 can be easily embedded into the fiber reinforced plastic shell 2 at molding of the shell, addition of the weight strap 8 to the golf club head causes no substantial increase in manufacturing steps. Loosening or accidental fall of the sole plate from the golf club head can be effectively prevented inasmuch as the sole plate is tightly and stably anchrored by means of the screws, to the weight strap firmly caught in the fiber reinforced plastic shell. Presence of the additional weight strap in the section of the shell defining the sole side locates the center of gravity of the golf club head at a low level for powerful inertia at swing of the golf club. Presence of the perforation in the weight strap assures stabler anchoring of the weight strap to the fiber reinforced plastic shell.

I claim:

1. A wood-type golf club head comprising
- a fiber reinforced plastic shell,
- a sole plate attached to the sole side of said fiber reinforced plastic shell, and
- a weight strap generally coextensive with said sole plate and fully embedded in and embraced by the section of said fiber reinforced plastic shell defining said sole side.

2. A wood-type golf club head as claimed in claim 1 in which
- said weight strap extends substantially in parallel to said sole plate.

3. A wood-type golf club head as claimed in claim 1 or 2 in which said sole plate is secured to said weight strap.

4. A wood-type golf club head as claimed in claim 3 in which
- said weight strap is provided with at least one perforation.

* * * * *